US006860969B2

(12) United States Patent
Troughton

(10) Patent No.: US 6,860,969 B2
(45) Date of Patent: Mar. 1, 2005

(54) PAPERMAKER'S FORMING FABRIC

(75) Inventor: Brian Troughton, Herne Bay (GB)

(73) Assignee: Weavexx Corporation, Wake Forest, NC (US)

( * ) Notice: Subject to any disclaimer, the term of this patent is extended or adjusted under 35 U.S.C. 154(b) by 46 days.

(21) Appl. No.: 10/354,452

(22) Filed: Jan. 30, 2003

(65) Prior Publication Data

US 2004/0149342 A1 Aug. 5, 2004

(51) Int. Cl.[7] ..... D21F 1/10; D21F 11/00; D03D 3/04

(52) U.S. Cl. ..... 162/348; 162/202; 162/903; 139/383 A

(58) Field of Search ..... 162/306, 348, 162/358.2, 358.4, 900–904, 202, 212, 116; 139/383 A, 425 A, 383 AA; 28/110, 142; 442/203–208, 238

(56) References Cited

U.S. PATENT DOCUMENTS

| | | | | |
|---|---|---|---|---|
| 2,172,430 A | 9/1939 | Barrell | ..... | 139/383 |
| 2,554,034 A | 5/1951 | Koester et al. | ..... | 139/426 |
| 3,094,149 A | 6/1963 | Keily | ..... | 139/383 |
| 3,325,909 A | 6/1967 | Clark | ..... | 34/95 |
| 4,093,512 A | 6/1978 | Fleischer | ..... | 162/348 |
| 4,182,381 A | 1/1980 | Gisbourne | ..... | 139/383 A |
| 4,244,543 A | 1/1981 | Ericson | ..... | 248/55 |
| 4,289,173 A | 9/1981 | Miller | ..... | 139/383 A |
| 4,290,209 A | 9/1981 | Buchanan et al. | ..... | 34/123 |
| 4,414,263 A | 11/1983 | Miller et al. | ..... | 428/234 |
| 4,438,788 A | 3/1984 | Harwood | ..... | 139/383 A |
| 4,452,284 A | 6/1984 | Eckstein et al. | ..... | 139/383 A |
| 4,453,573 A | 6/1984 | Thompson | ..... | 139/383 A |
| 4,501,303 A | 2/1985 | Osterberg | ..... | 139/425 A |
| 4,515,853 A | 5/1985 | Borel | ..... | 428/257 |
| 4,529,013 A | 7/1985 | Miller | ..... | 139/383 A |

(List continued on next page.)

FOREIGN PATENT DOCUMENTS

| | | | | |
|---|---|---|---|---|
| CA | 1115177 | 12/1981 | ..... | 139/58 |
| CN | 2-277848 | 4/1998 | ..... | D03D/15/00 |
| DE | 454 092 | 12/1927 | | |
| DE | 33 29 740 | 3/1985 | ..... | D03D/11/00 |

(List continued on next page.)

OTHER PUBLICATIONS

Warren, C.A., "The Importance of Yarn Properties in Wet–End Wire Construction," Seminar, The Theory of Water Removal, Dec. 12, 1979.

International Search Report for PCT Application No. PCT/US97/18627.

International Search Report for PCT Application No. PCT/US97/18629.

Rule 132 Declaration of Robert G. Wilson (Jun. 26, 1997).

International Search Report and Written Opinion for PCT/US2004/003567 dated Jul. 29, 2004.

*Primary Examiner*—Peter Chin
*Assistant Examiner*—Eric Hug
(74) *Attorney, Agent, or Firm*—Myers Bigel Sibley & Sajovec

(57) ABSTRACT

A papermaker's fabric includes top MD yarns, top CMD yarns, bottom MD yarns, bottom CMD yarns and stitching yarns. The fabric is formed in a plurality of repeating units, each of the repeating units including a set of top MD yarns, a set of top CMD yarns interwoven with the set of top MD yarns to form a top fabric layer, a set of four or eight bottom MD yarns, a set of bottom CMD yarns interwoven with the set of four or eight bottom MD yarns to form a bottom fabric layer and a set of stitching yarns interwoven with the top and bottom fabric layers. The bottom MD yarns and the bottom CMD yarns are interwoven in a series of repeat units in which each of the bottom MD yarns passes below two nonadjacent bottom CMD yarns to form bottom machine direction knuckles, each bottom machine direction knuckle being separated from one adjacent knuckle formed by that bottom machine direction yarn by two bottom CMD yarns and separated from another adjacent knuckle by four CMD yarns.

24 Claims, 14 Drawing Sheets

U.S. PATENT DOCUMENTS

| | | | | |
|---|---|---|---|---|
| 4,564,052 | A | 1/1986 | Borel | 139/425 A |
| 4,592,395 | A | 6/1986 | Borel | 139/383 A |
| 4,592,396 | A | 6/1986 | Borel et al. | 139/425 |
| 4,605,585 | A | 8/1986 | Johansson | 428/224 |
| 4,611,639 | A | 9/1986 | Bugge | 139/383 A |
| 4,621,663 | A | 11/1986 | Malmendier | 139/383 A |
| 4,633,596 | A | 1/1987 | Josef | 34/116 |
| 4,636,426 | A | 1/1987 | Fleischer | 428/224 |
| 4,642,261 | A | 2/1987 | Fearnhead | 428/225 |
| 4,676,278 | A | 6/1987 | Dutt | 139/383 A |
| 4,705,601 | A | 11/1987 | Chiu | 162/348 |
| 4,709,732 | A | 12/1987 | Kinnunen | 139/383 A |
| 4,729,412 | A | 3/1988 | Bugge | 139/383 A |
| 4,731,281 | A | 3/1988 | Fleischer et al. | 428/196 |
| 4,739,803 | A | 4/1988 | Borel | 139/383 A |
| 4,755,420 | A | 7/1988 | Baker et al. | 428/222 |
| 4,759,975 | A | 7/1988 | Sutherland et al. | 428/234 |
| 4,815,499 | A | 3/1989 | Johnson | 139/383 |
| 4,815,503 | A | 3/1989 | Borel | 139/383 A |
| 4,909,284 | A | 3/1990 | Kositzke | |
| RE33,195 | E | 4/1990 | McDonald et al. | 139/425 |
| 4,934,414 | A | 6/1990 | Borel | 139/383 A |
| 4,941,514 | A | 7/1990 | Taipale | 139/383 A |
| 4,942,077 | A | 7/1990 | Wendt et al. | 428/152 |
| 4,945,952 | A | 8/1990 | Vöhringer | 139/383 |
| 4,967,805 | A | 11/1990 | Chiu et al. | 139/383 |
| 4,987,929 | A | 1/1991 | Wilson | 139/383 A |
| 4,989,647 | A | 2/1991 | Marchand | 139/383 A |
| 4,989,648 | A | 2/1991 | Tate et al. | 139/383 |
| 4,998,568 | A | 3/1991 | Vohringer | 139/383 A |
| 4,998,569 | A | 3/1991 | Tate | 139/383 A |
| 5,022,441 | A | 6/1991 | Tate et al. | 139/383 A |
| 5,025,839 | A | 6/1991 | Wright | 139/383 A |
| 5,067,526 | A | 11/1991 | Herring | 139/383 A |
| 5,074,339 | A | 12/1991 | Vohringer | 139/383 A |
| 5,084,326 | A | 1/1992 | Vohringer | 428/194 |
| 5,092,372 | A | 3/1992 | Fitzka et al. | 139/383 A |
| 5,101,866 | A | 4/1992 | Quigley | 139/383 |
| 5,116,478 | A | 5/1992 | Tate et al. | 162/358 |
| 5,152,326 | A | 10/1992 | Vohringer | 139/383 A |
| 5,158,118 | A | 10/1992 | Tate et al. | 139/383 A |
| 5,219,004 | A | 6/1993 | Chiu | 139/383 A |
| 5,228,482 | A | 7/1993 | Fleischer | 139/383 A |
| 5,238,536 | A | 8/1993 | Danby | 162/348 |
| 5,277,967 | A | 1/1994 | Zehle et al. | 139/383 A |
| 5,358,014 | A | 10/1994 | Kovar | 139/383 A |
| 5,421,374 | A | 6/1995 | Wright | 139/383 A |
| 5,421,375 | A | 6/1995 | Praetzel | 139/383 A |
| 5,429,686 | A | 7/1995 | Chiu et al. | 139/383 |
| 5,449,026 | A | 9/1995 | Lee | 139/383 A |
| 5,454,405 | A | 10/1995 | Hawes | 139/383 A |
| 5,456,293 | A | 10/1995 | Ostermayer et al. | 139/383 A |
| 5,465,764 | A | 11/1995 | Eschmann et al. | 139/383 A |
| 5,482,567 | A | 1/1996 | Barreto | 139/383 A |
| 5,487,414 | A | 1/1996 | Kuji et al. | 139/383 |
| 5,518,042 | A | 5/1996 | Wilson | 139/383 A |
| 5,520,225 | A | 5/1996 | Quigley et al. | 139/383 A |
| 5,542,455 | A | 8/1996 | Ostermayer et al. | 139/383 A |
| 5,555,917 | A | 9/1996 | Quigley | 139/383 A |
| 5,564,475 | A | 10/1996 | Wright | 139/383 A |
| 5,641,001 | A | 6/1997 | Wilson | 139/383 A |
| 5,651,394 | A | 7/1997 | Marchand | 139/383 |
| 5,709,250 | A | 1/1998 | Ward et al. | 139/383 A |
| RE35,777 | E | 4/1998 | Givin | 139/383 A |
| 5,746,257 | A | 5/1998 | Fry | 139/383 AA |
| 5,826,627 | A | * 10/1998 | Seabrook et al. | 139/383 A |
| 5,857,498 | A | 1/1999 | Barreto et al. | 139/383 |
| 5,881,764 | A | 3/1999 | Ward | 139/383 A |
| 5,937,914 | A | 8/1999 | Wilson | 139/383 A |
| 5,967,195 | A | 10/1999 | Ward | 138/383 |
| 5,983,953 | A | 11/1999 | Wilson | 139/383 |
| 6,123,116 | A | 9/2000 | Ward et al. | 139/383 A |
| 6,145,550 | A | 11/2000 | Ward | 139/383 |
| 6,148,869 | A | 11/2000 | Quigley | 139/383 |
| 6,158,478 | A | 12/2000 | Lee et al. | 139/383 A |
| 6,227,255 | B1 | 5/2001 | Osterberg et al. | |
| 6,244,306 | B1 | 6/2001 | Troughton | 139/383 |
| 6,253,796 | B1 | 7/2001 | Wilson et al. | 139/383 |
| 6,276,402 | B1 * | 8/2001 | Herring | 139/383 A |
| 6,354,335 | B1 * | 3/2002 | Taipale et al. | 139/383 A |
| 2004/0020621 | A1 * | 2/2004 | Heger et al. | 162/348 |

FOREIGN PATENT DOCUMENTS

| | | | |
|---|---|---|---|
| EP | 0 048 962 | 9/1981 | D03D/1/00 |
| EP | 0 158 710 | 10/1984 | D03D/1/00 |
| EP | 0 185 177 | 10/1985 | D03D/11/00 |
| EP | 0 224 276 | 12/1986 | |
| EP | 0 264 881 | 10/1987 | D21F/1/00 |
| EP | 0 269 070 | 11/1987 | D03D/11/00 |
| EP | 0 284 575 | 2/1988 | D21F/1/00 |
| EP | 0 283 181 | 3/1988 | D21F/1/00 |
| EP | 0 350 673 | 6/1989 | D21F/1/00 |
| EP | 0 048 849 A3 | 5/1990 | |
| EP | 0 048 849 A2 | 5/1990 | D21F/1/00 |
| EP | 0 672 782 | 3/1995 | D21F/1/00 |
| EP | 0 794 283 A1 | 9/1997 | D21F/1/00 |
| FR | 2 597 123 | 4/1986 | D03D/11/00 |
| FR | 8605115 | 4/1986 | |
| GB | 2157328 A | 10/1985 | D03D/1/00 |
| GB | 2245006 | 2/1991 | D03D/11/00 |
| JP | 8-158285 | 12/1994 | |
| JP | 9-41282 | 7/1995 | |
| JP | 9-87990 | 9/1995 | |
| WO | WO 86/00099 | 1/1986 | D21F/1/00 |
| WO | WO 89/09848 | 4/1989 | D03D/23/00 |
| WO | WO 93/10304 | 11/1992 | D21F/1/10 |

* cited by examiner

PAPERMAKER'S FORMING FABRIC

FIELD OF THE INVENTION

This invention relates generally to woven fabrics, and relates more specifically to woven fabrics for papermakers.

BACKGROUND OF THE INVENTION

In the conventional fourdrinier papermaking process, a water slurry, or suspension, of cellulosic fibers (known as the paper "stock") is fed onto the top of the upper run of an endless belt of woven wire and/or synthetic material that travels between two or more rollers. The belt, often referred to as a "forming fabric", provides a papermaking surface on the upper surface of its upper run which operates as a filter to separate the cellulosic fibers of the paper stock from the aqueous medium, thereby forming a wet paper web. The aqueous medium drains through mesh openings of the forming fabric, known as drainage holes, by gravity alone or with assistance from one or more suction boxes located on the lower surface (i.e., the "machine side") of the upper run of the fabric.

After leaving the forming section, the paper web is transferred to a press section of the paper machine, in which it is passed through the nips of one or more pairs of pressure rollers covered with another fabric, typically referred to as a "press felt." Pressure from the rollers removes additional moisture from the web; the moisture removal is often enhanced by the presence of a "batt" layer on the press felt. The paper is then conveyed to a drier section for further moisture removal. After drying, the paper is ready for secondary processing and packaging.

Typically, papermaker's fabrics are manufactured as endless belts by one of two basic weaving techniques. In the first of these techniques, fabrics are flat woven by a flat weaving process, with their ends being joined to form an endless belt by any one of a number of well-known joining methods, such as dismantling and reweaving the ends together (commonly known as splicing), or sewing a pin-seamable flap on each end or a special foldback, then reweaving these into pin-seamable loops. In a flat woven papermaker's fabric, typically the warp yarns extend in the machine direction and the filling yarns extend in the cross machine direction. In the second technique, fabrics are woven directly in the form of a continuous belt with an endless weaving process. In the endless weaving process, the warp yarns extend in the cross machine direction and the filling yarns extend in the machine direction. As used herein, the terms "machine direction" (MD) and "cross machine direction" (CMD) refer, respectively, to a direction aligned with the direction of travel of the papermaker's fabric on the papermaking machine, and a direction parallel to the fabric surface and traverse to the direction of travel. Both weaving methods described hereinabove are well known in the art, and the term "endless belt" as used herein refers to belts made by either method.

Effective sheet and fiber support and an absence of wire marking are typically important considerations in papermaking, especially for the forming section of the papermaking machine, where the wet web is initially formed. Wire marking is particularly problematic in the formation of fine paper grades, as it can affect a host of paper properties, such as sheet mark, porosity, "see through" and pin holing. Wire marking is typically the result of individual cellulosic fibers being oriented within the paper web such that their ends reside within gaps between the individual threads or yarns of the forming fabric. This problem is generally addressed by providing a permeable fabric structure with a coplanar surface that allows paper fibers to bridge adjacent yarns of the fabric rather than penetrate the gaps between yarns. As used herein, "coplanar" means that the upper extremities of the yarns defining the paper-forming surface are at substantially the same elevation, such that at that level there is presented a substantially "planar" surface. Accordingly, fine paper grades intended for use in quality printing, carbonizing, cigarettes, electrical condensers, and like grades of fine paper have typically heretofore been formed on very finely woven or fine wire mesh forming fabrics.

Typically, such finely woven fabrics include at least some relatively small diameter machine direction or cross machine direction yarns. Regrettably, however, such yarns tend to be delicate, leading to a short surface life for the fabric. Moreover, the use of smaller yarns can also adversely effect the mechanical stability of the fabric (especially the skew resistance, propensity for narrowing and stiffness), which may negatively impact both the service life and the performance of the fabric.

To combat these problems associated with fine weaves, multi-layer forming fabrics have been developed with fine-mesh yarns on the paper-forming surface to facilitate paper formation and coarser-mesh yarns on the machine contact side to provide strength and durability. For example, fabrics have been constructed which employ one set of machine direction yarns which interweave with two sets of cross machine direction yarns to form a fabric having a fine paper forming surface and a more durable machine side surface. These fabrics form part of a class of fabrics which are generally referred to as "double layer" fabrics. Similarly, fabrics have been constructed which include two sets of machine direction yarns and two sets of cross machine direction yarns that form a fine mesh paper side fabric layer and a separate, coarser machine side fabric layer. In these fabrics, which are part of a class of fabrics generally referred to as "triple layer" fabrics, the two fabric layers are typically bound together by separate stitching yarns. As double and triple layer fabrics include additional sets of yarn as compared to single layer fabrics, these fabrics typically have a higher "caliper" (i.e., they are thicker than) comparable single layer fabrics. An illustrative double layer fabric is shown in U.S. Pat. No. 4,423,755 to Thompson, and illustrative triple layer fabrics are shown in U.S. Pat. No. 4,501,303 to Osterberg, U.S. Pat. No. 5,152,326 to Vohringer, U.S. Pat. Nos. 5,437,315 5,967,195, and 6,145,550 to Ward, and U.S. Pat. No. 6,244,306 to Troughton, the disclosures of which are hereby incorporated by reference in their entirety.

Although these fabrics have performed successfully, they have some potential shortcomings that may relate to the inclusion of the stitching yarns, for example, problems with interlayer wear. As the fabric is used on a paper machine, the top and bottom layers tend to shift relative to one another, both in the machine direction and the cross machine direction, due to the tension imparted to the fabric by the rolls. This effect is exacerbated on paper machines, such as the so-called "high-wrap" machines, that include multiple rolls, including some which contact the top layer of the fabric. This shifting can cause the fabric to wear and decrease in thickness, which can adversely affect the drainage of the fabric and, accordingly, its performance in papermaking. In many instances, it is this interlayer wear, rather than the wear of the machine side surface of the fabric machine against the paper machine, that determines the longevity of the fabric.

Also, the stitching yarns of a triple layer fabric should be sufficiently strong and durable to bind the top and bottom layers and to resist the wear and abrasion conditions that the bottom layer experiences while in contact with the paper machine, yet should be delicate enough to produce high quality paper. This balance can be difficult to strike.

SUMMARY OF THE INVENTION

The present invention is directed to papermaker's fabrics that can address some of the wear and abrasion issues noted above. In certain embodiments according to the present invention, a papermaker's fabric includes top MD yarns, top CMD yarns, bottom MD yarns, bottom CMD yarns and stitching yarns. The fabric is formed in a plurality of repeating units, each of the repeating units including a set of top MD yarns, a set of top CMD yarns interwoven with the set of top MD yarns to form a top fabric layer, a set of four bottom MD yarns, a set of bottom CMD yarns interwoven with the set of four bottom MD yarns to form a bottom fabric layer and a set of stitching yarns interwoven with the top and bottom fabric layers. The bottom MD yarns and the bottom CMD yarns are interwoven in a series of repeat units in which each of the bottom MD yarns passes below two nonadjacent bottom CMD yarns to form bottom machine direction knuckles, each bottom machine direction knuckle being separated from one adjacent knuckle formed by that bottom machine direction yarn by two bottom CMD yarns and separated from another adjacent knuckle also formed by that bottom MD yarn by four bottom CMD yarns. In this configuration, the bottom MD yarns present stitching locations for the stitching yarns that can be very favorable for avoiding abrasion and wear. The stitching locations form a symmetrical pattern that may be easier to manufacture.

In other embodiments according to the present invention, the papermaker's fabric discussed above includes pairs of first and second stitching yarns positioned between pairs of top CMD yarns. The first and second stitching yarns of each pair are interwoven with the top and bottom MD yarns such that, as a fiber support portion of the first stitching yarn is interweaving with the top MD yarns, a binding portion of the second stitching yarn is positioned below the top MD yarns, and such that as a fiber support portion of the second stitching yarn is interweaving with the top MD yarns, a binding portion of the first stitching yarn is positioned below the top MD yarns. The first and second stitching yarns cross each other as they pass below a transitional top MD yarn, and each of the binding portions of the first and second stitching yarns passes below at least one of the bottom MD yarns.

In other embodiments of the present invention, embodiments of the papermaker's fabrics described above may be used to make paper. A paper stock may be applied to a papermaker's fabric as described above, and moisture may be removed from the paper stock to produce paper.

DETAILED DESCRIPTION OF EMBODIMENTS OF THE INVENTION

Figure 1:
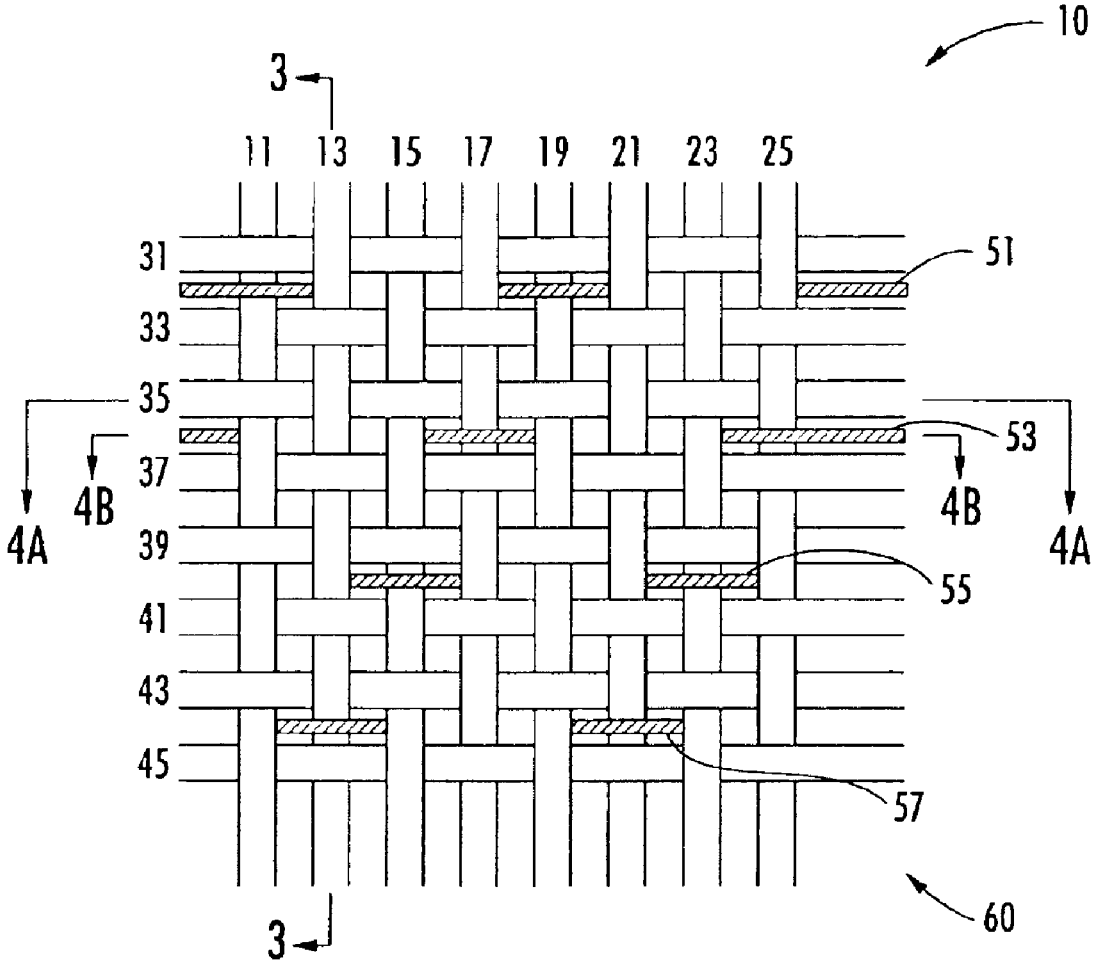
FIG. 1 is a top view of a triple layer forming fabric of the present invention.

The present invention will now be described more particularly hereinafter with reference to the accompanying drawings, in which preferred embodiments of the invention are shown. The invention, however, be embodied in many different forms and is not limited to the embodiments set forth herein; rather, these embodiments are provided so that the disclosure will fully convey the scope of the invention to those skilled in the art. Like numbers refer to like components throughout. The dimensions and thicknesses for some elements and the spacing between elements may be exaggerated for clarity.

An eight harness triple layer forming fabric, generally designated at 10, is illustrated in FIGS. 1, 2, and 3A–3C, in which a single repeat unit of the fabric 10 is shown. The repeat unit of the fabric 10 includes a top layer 60 and a bottom layer 80. The top layer 60 includes eight top MD yarns 11, 13, 15, 17, 19, 21, 23, and 25 and eight top CMD yarns 31, 33, 35, 37, 39, 41, 43, and 45. These are interwoven such that each top CMD yarn passes over and beneath top MD yarns in an alternating fashion, with adjacent top CMD yarns being offset by one top MD yarn to form a plain weave pattern. For example, top CMD yarn 35 passes over top MD yarn 11, under top MD yarn 13, over top MD yarn 15, under top MD yarn 17 and so on until it passes under top MD yarn 25. Top MD yarn 11 passes under top CMD yarn 31, over top CMD yarn 33, under top CMD yarn 35, over top CMD yarn 39 and so on until it passes under top CMD 45. Stitching yarns 51, 53, 55 and 57 pass over various MD yarns to stitch the top layer 60 of the fabric 10 to the bottom layer 80 in a manner described in detail below.

Figure 2:
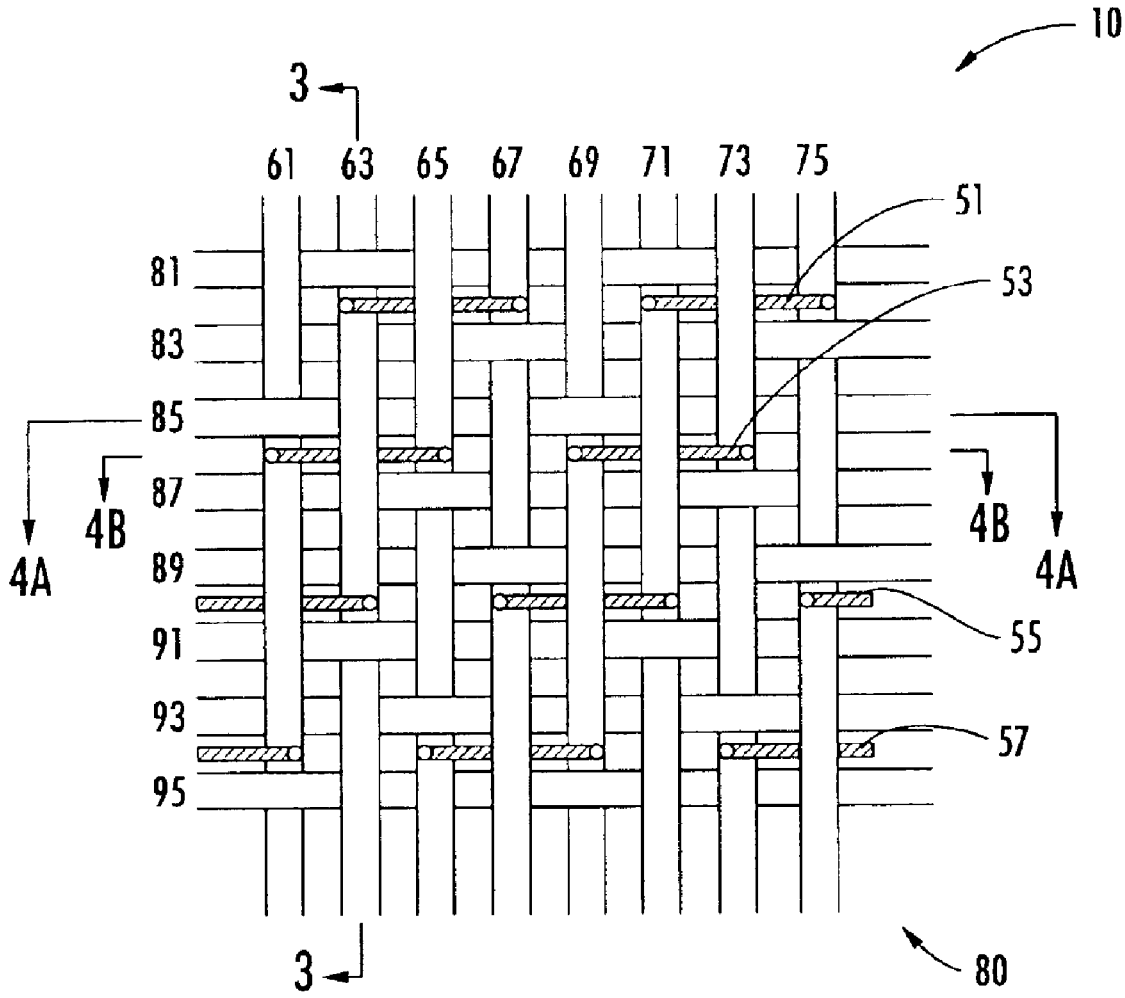
FIG. 2 is a top section view of the bottom layer of the fabric of FIG. 1 with the top layer removed.

Referring now to FIG. 2, the repeat unit of the fabric 10 also includes the bottom layer 80. The bottom layer 80 includes eight bottom MD yarns 61, 63, 65, 67, 69, 71, 73, and 75, which are interwoven with eight bottom CMD yarns 81, 83, 85, 87, 89, 91, 93, and 95. In this embodiment, each of the bottom MD and CMD yarns is positioned substantially directly below a corresponding top MD or CMD yarn, although weave patterns in which such is not the case are possible. The bottom MD yarns are interwoven with the bottom CMD yarns in a pattern in which each bottom MD yarn passes under one bottom CMD yarn, over four adjacent bottom CMD yarns, below the next bottom CMD yarn, and over the next two adjacent bottom CMD yarns. For example, bottom MD yarn 63 passes below bottom CMD yarn 81, above bottom CMD yarns 83, 85, 87, and 89, below bottom CMD yarn 91, above bottom CMD yarns 93 and 95. The other bottom MD yarns follow a similar "under 1/over 4/under 1/over 2" weave pattern, but each is offset in its weaving sequence from its nearest bottom MD yarn neighbors by two bottom CMD yarns. Consequently, bottom MD yarn 61 (which is adjacent bottom MD yarn 63) passes below bottom CMD yarn 85, above bottom CMD yarns 87, 89, 91, and 93, below bottom CMD yarn 95, and above bottom CMD yarns 81 and 83. Thus, the bottom MD "knuckle" formed by bottom MD yarn 63 as it passes below bottom CMD yarn 91 is offset from the bottom "knuckle" formed by bottom MD yarn 61 as it passes below bottom CMD yarn 95 by two bottom CMD yarns.

The bottom CMD yarns follow an "over 1/under 3" pattern that is repeated twice within the repeat unit. The bottom layer 80 has a repeat unit of four bottom MD yarns. For example, bottom CMD yarn 85 passes over bottom MD yarn 61, under bottom MD yarns 63, 65, and 67, over bottom MD yarn 69 and under bottom MD yarns 71, 73 and 75, while bottom CMD yarn 87 passes over bottom MD yarn 65, under bottom MD yarns 67, 69, and 71, over bottom MD yarn 73, and under bottom MD yarns 75, 61 and 63.

Referring back to FIG. 1, and also referring to FIG. 2, the top layer 60 includes portions of four stitching yarns 51, 53, 55, and 57. The stitching yarns 51, 53, 55, and 57 are positioned between adjacent top and bottom CMD yarns such that each stitching yarn is separated from an adjacent stitching yarn by two top and two bottom CMD yarns. For example, stitching yarn 51 is separated from stitching yarn 53 by top CMD yarns 33 and 34 and bottom CMD yarns 83 and 85.

Figure 3:
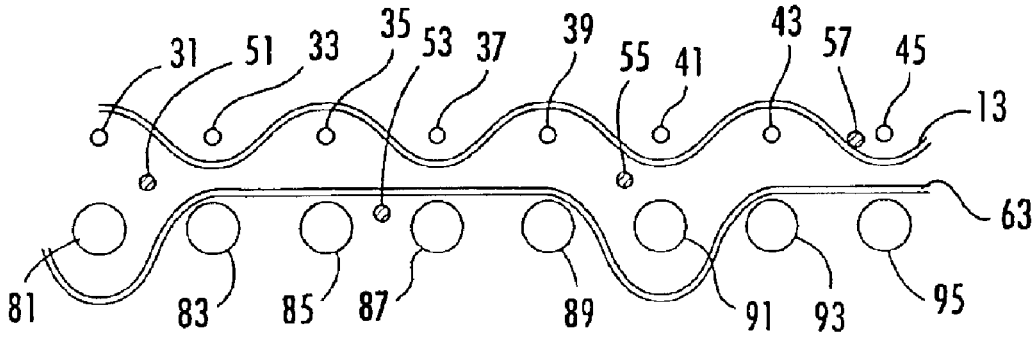
FIG. 3 is a section view taken along line 3—3 shown in FIGS. 1 and 2 of the fabric thereof.
Figure 4A:
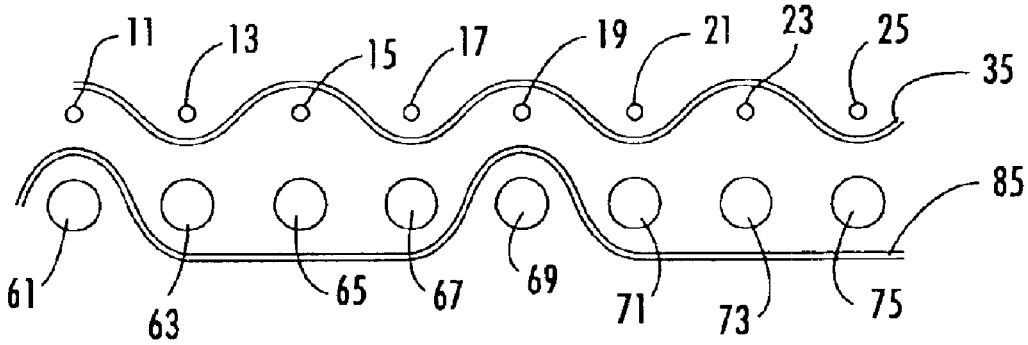
FIGS. 4A–B are section views taken along, respectively, lines 4A—4A and 4B—4B shown in FIGS. 1 and 2 of the fabric thereof.
Figure 4B:
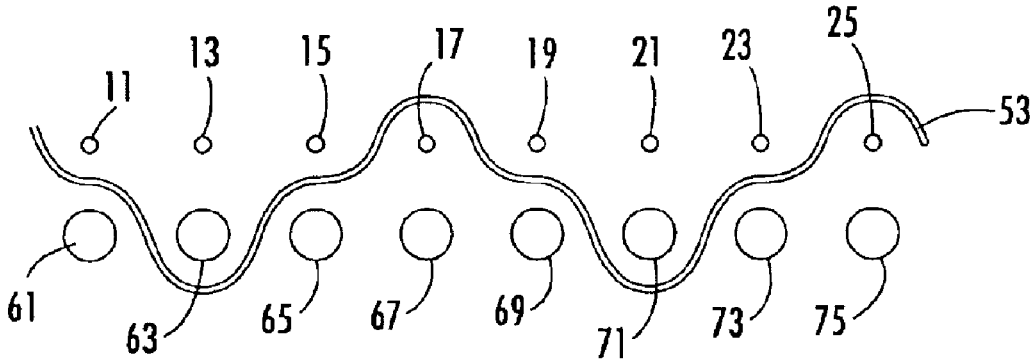
Figure 5:
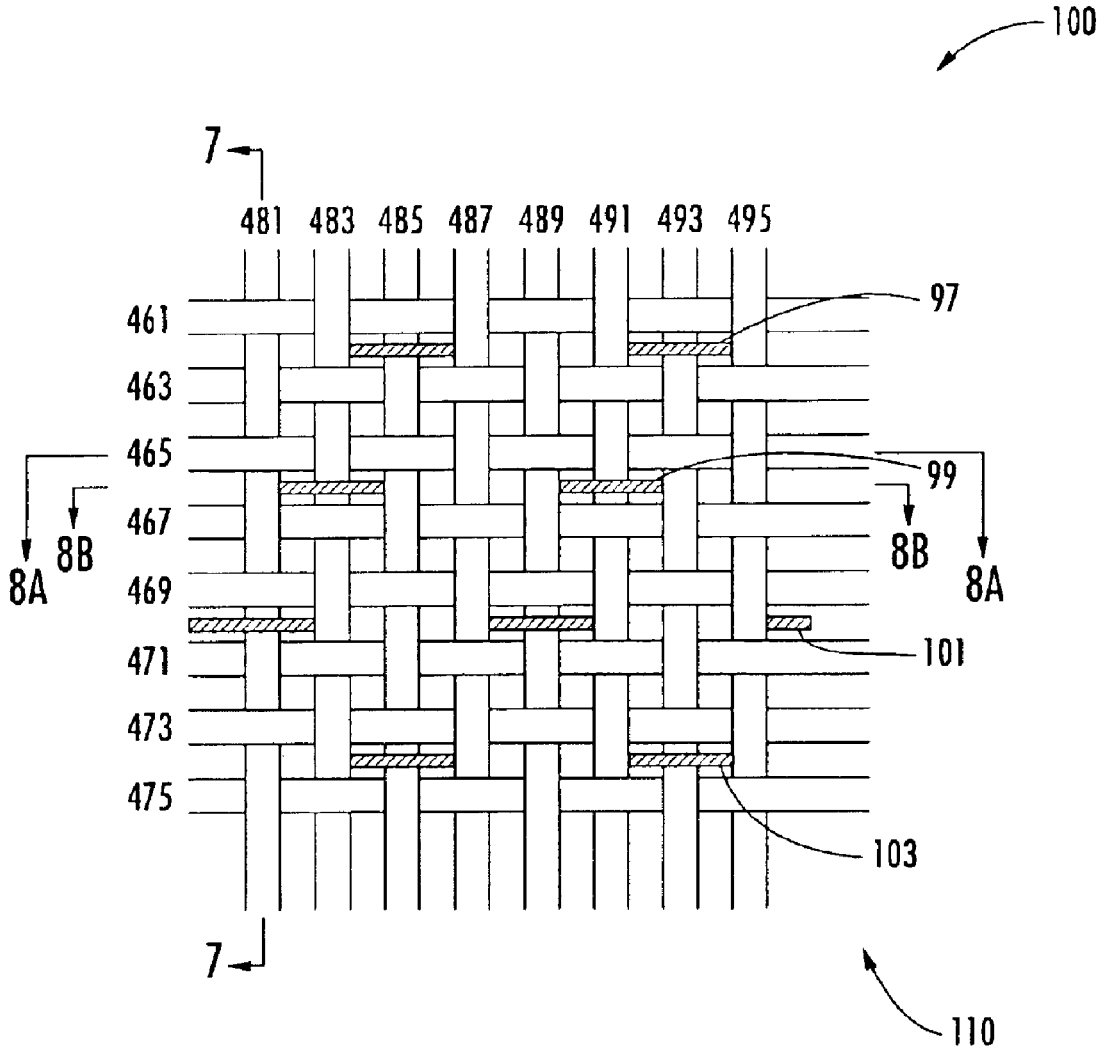
FIG. 5 is a top view of another embodiment of a triple layer forming fabric of the present invention.

As can be seen in FIGS. 3 and 4A–B, stitching yarns interweave with the top MD yarns and bottom MD yarns in the following pattern. Each of the stitching yarns of the repeat unit can be subdivided into two portions: an upper portion which interweaves with the top MD yarns, and a lower portion which interweaves with a bottom MD yarn. As discussed above, the bottom MD yarns form an "under 1/over 4/under 1/over 2" weave pattern. Thus, the bottom MD yarns form knuckles under nonadjacent bottom CMD yarns such that each knuckle is separated from adjacent knuckles by two bottom CMD yarns one side and four bottom CMD yarns on the other. For example, in FIG. 3, bottom MD yarn 63 forms knuckles with bottom CMD yarns 81 and 91. The knuckles are separated by four bottom CMD yarns 83, 85, 87 and 89 on one side and by two bottom CMD yarns 93 and 95 on the other side.

The stitching yarns are interwoven relative to the bottom MD yarns such that the lower portion of each stitching yarn forms a binding knuckle with the bottom MD yarn between the second and third of the four bottom CMD yarns separating two adjacent bottom MD knuckles. For example, bottom MD yarn 63 forms knuckles with CMD yarns 81 and 91. The knuckles are separated by four bottom CMD yarns 83, 85, 87 and 89. A stitching yarn 53 forms a knuckle with the bottom MD yarn 63 between the second and third of the four bottom CMD yarns, that is, bottom CMD yarns 85 and 87 (e.g., FIG. 3). It has been discovered that, in this configuration, the stitching yarns may be better protected from wear. The bottom MD yarn 63 "floats" between the bottom CMD yarns 81 and 91 and arches somewhat above the four bottom CMD yarns 83, 85, 87 and 89. Thus, placing the stitching yarn 53 in a position that is central to the "arch" of the bottom MD yarn 63 (between bottom CMD yarns 85 and 87) may allow protection from wear because stitching yarn 53 is then located some distance from the lower surface of the bottom layer 80, thereby reducing wear on the stitching yarn 53. Each of the other stitching yarns 51, 53, 55, 57 also binds below a bottom MD yarn between the second and third yarns of a four yarn float found by that bottom MD yarn.

FIGS. 5, 6, 7 and 8A–8B illustrate an alternative embodiment of a triple layer fabric designated broadly at 100. The triple layer fabric 100 includes a top layer 110 and a bottom layer 120. The top layer 110 includes eight top MD yarns 481, 483, 485, 487, 489, 491, 493 and 495 interwoven with eight top CMD yarns 461, 463, 465, 467, 469, 471, 473 and 475, as well as stitching yarns 97, 99, 101, and 103. The top CMD yarns and the top MD yarns are interwoven to form a plain weave surface similar to that in the fabric 10 described above. The top CMD yarns and the stitching yarns are arranged such that a stitching yarns follows every two top CMD yarns in repeating pattern. For example, stitching yarn 97 is separated from stitching yarn 99 by top CMD yarns 463 and 465, and stitching yarn 99 is separated from stitching yarn 101 by top CMD yards 467 and 469, and so on.

The bottom layer 120 includes eight bottom MD direction yarns 131, 133, 135, 137, 139, 141, 143 and 145 interwoven with eight bottom CMD yarns 111, 113, 115, 117, 119, 121, 123, and 125. The weaving pattern of the bottom MD yarns relative to the bottom CMD yarns is identical to that described above for the fabric 10, namely, each bottom MD yarn follows an "under 1/over 4/under 1/over 2" pattern relative to the bottom CMD yarn, and adjacent bottom MD yarns are offset from one another by two bottom CMD yarns. As a result, the characteristic bottom MD knuckles formed under bottom CMD yarns are separated from one another by, alternately, four bottom CMD yarns on one side of a knuckle and two bottom CMD yarns on the other side of a knuckle, similar to fabric 10 discussed above.

As with fabric 10, the stitching yarns are interwoven with bottom MD yarns to form binding knuckles between the knuckles formed by the bottom MD yarns and the bottom CMD yarns. However, the binding knuckles formed by the stitching yarns and bottom MD yarns in fabric 100 are formed between two bottom CMD yarns that separate two bottom MD yarn knuckles. For example, in FIG. 7, stitching yarn 97 forms a binding knuckle with bottom MD yarn 131. The binding knuckle is located between bottom CMD yarns 111 and 113. Bottom MD yarn 131 in turn forms knuckles with bottom CMD yarns 115 and 125. These knuckles at bottom CMD yarns 125 and 115 are separated from one another by bottom CMD yarns 111 and 113.

The performance advantages discussed above for fabric 10 may also be achieved with fabric 100. Specifically, the binding knuckles are located between two bottom CMD yarns, which in turn separate two bottom CMD/MD yarn knuckles. Thus, the bottom CMD yarns on either side of the binding knuckle can protect the stitching yarns from contact with the paper machine and from the resulting wear. By being so located, the binding knuckles are located at the apex of the float that the bottom MD yarns form over the bottom CMD yarns. Therefore, the binding knuckles are positioned away from the lower surface of the bottom layer 120, and are less susceptible to contact with the paper machine and the resulting wear.

As would be appreciated by those of skill in the art, various top fabric layer configurations and weave patterns may be substituted for the top layers 60 and 110 discussed above. For example, in fabrics 10 and 100, when either of the bottom layers 80 and 120 are joined with the respective top layers 60 and 110, each of the bottom CMD yarns is positioned substantially directly below a corresponding top CMD yarn. There is no bottom CMD yarn positioned substantially directly below the stitching yarn, thereby providing a space in which the stitching yarns can stitch below a bottom CMD yarn. Of course, those skilled in this art will appreciate that the fabric may have differing numbers of top and bottom CMD yarns in a repeat unit; for example, there may be 1.5, two or three times as many top CMD yarns as bottom CMD yarns, or there may be a CMD yarn below each stitching yarn. Also, the top layers 60 and 110 may vary from plain weave patterns illustrated herein; for example, the pattern of the top layer may be satin, twill, broken twill, or the like.

Those skilled in this art will appreciate that, although the illustrated fabrics employ a single stitching yarn, stitching yarn pairs may also be employed. Stitching yarn pairs can be incorporated into the paper making surface of the fabric as is disclosed in U.S. Pat. No. 6,145,550 to Ward. Examples of triple layer fabrics using stitching yarn pairs is illustrated are FIGS. 9–16B.

One example of a triple layer fabric, designated 170, is shown in FIGS. 9, 10, 11A–H, and 12A–12B. The fabric 170 has a top layer 150 and a bottom layer 200, which are stitched together by stitching yarn pairs 187A, 187B, 189A, 189B, 191A, 191B, 193A and 193B. The top layer 150 includes top MD yarns 171, 173, 175, 177, 179, 181, 183 and 185 interwoven with eight top CMD yarns 151, 153, 155, 157, 159, 161, 163 and 165. The top MD yarns are interwoven with the top CMD yarns and the stitching yarns in an "over/under" pattern. For example, top MD yarn 173 passes over top CMD yarn 151, under stitching yarn 187B, over top CMD yarn 153, under top CMD yarn 155 and so forth until it passes under top CMD yarn 165. Thus, the stitching yarns pairs 187A, 187B, 189A, 189B, 191A, 191B, 193A, and 193B form an integral part of the top layer 150.

Figure 6:
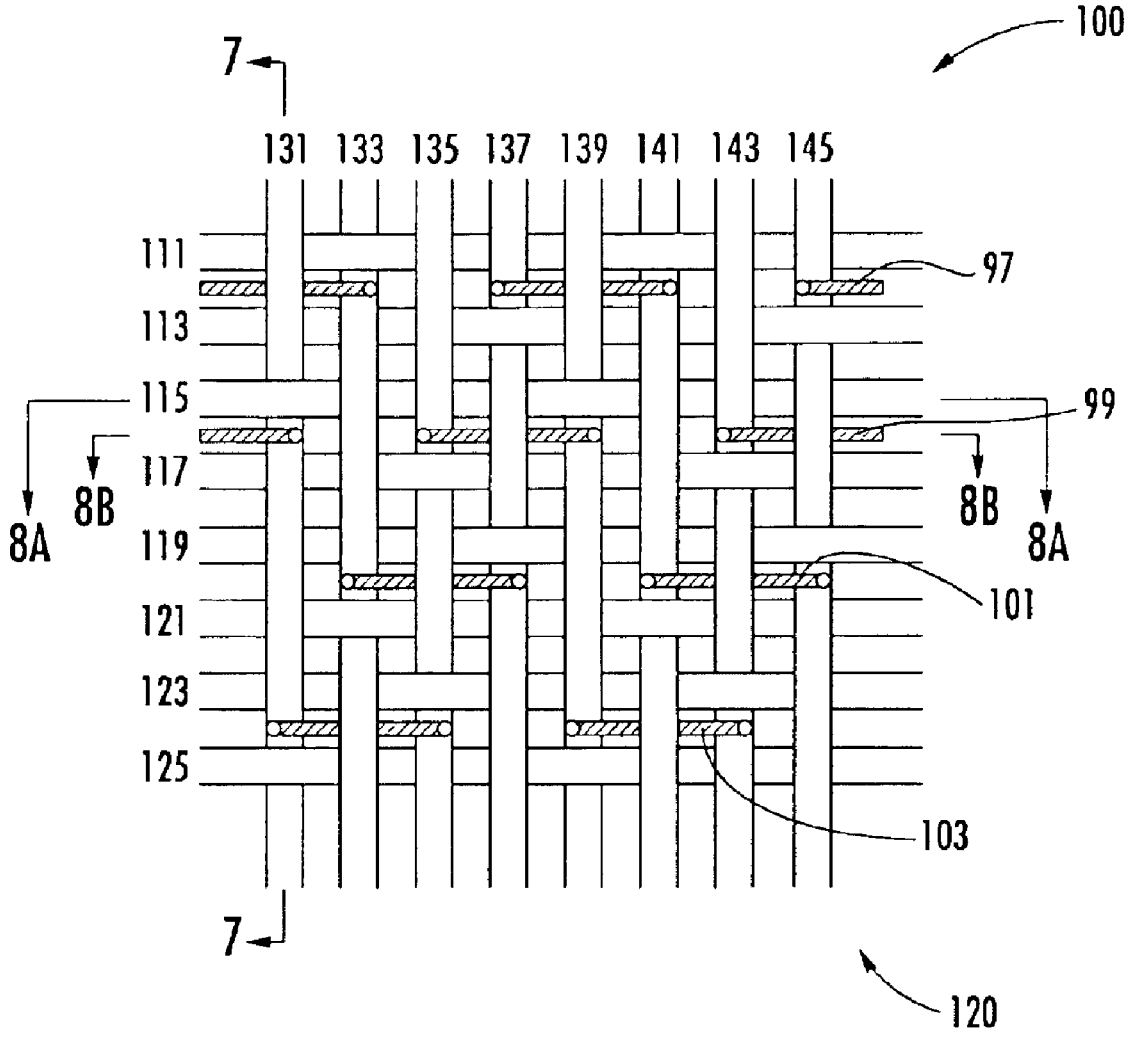
FIG. 6 is a top section view of the bottom layer of the fabric of FIG. 5 with the top layer removed.
Figure 7:
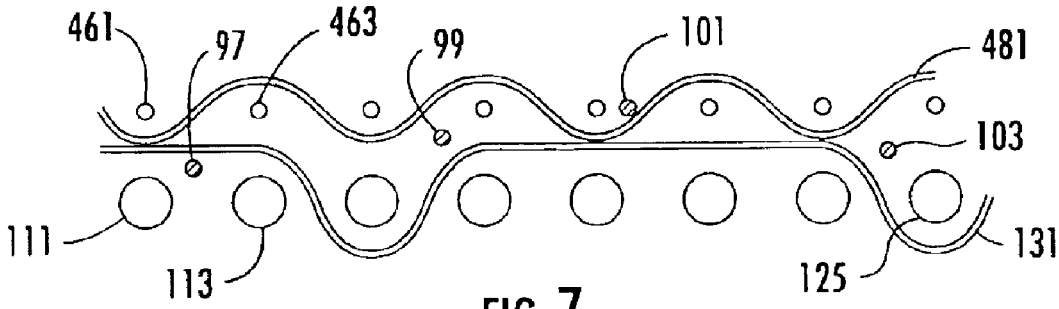
FIG. 7 is a section view taken along line 7—7 shown in FIGS. 5 and 6 of the fabric thereof.
Figure 8A:
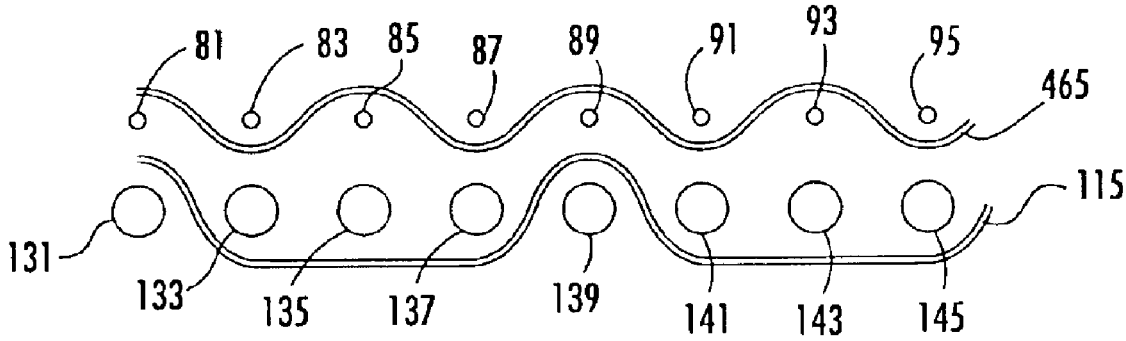
FIGS. 8A–8B are section views taken along, respectively, lines 8A—8A and 8B—8B shown in FIGS. 5 and 6 of the fabric thereof.
Figure 8B:
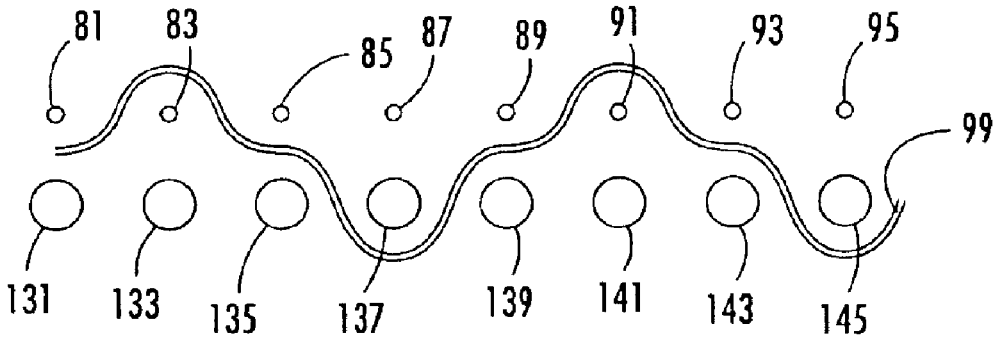
Figure 9:
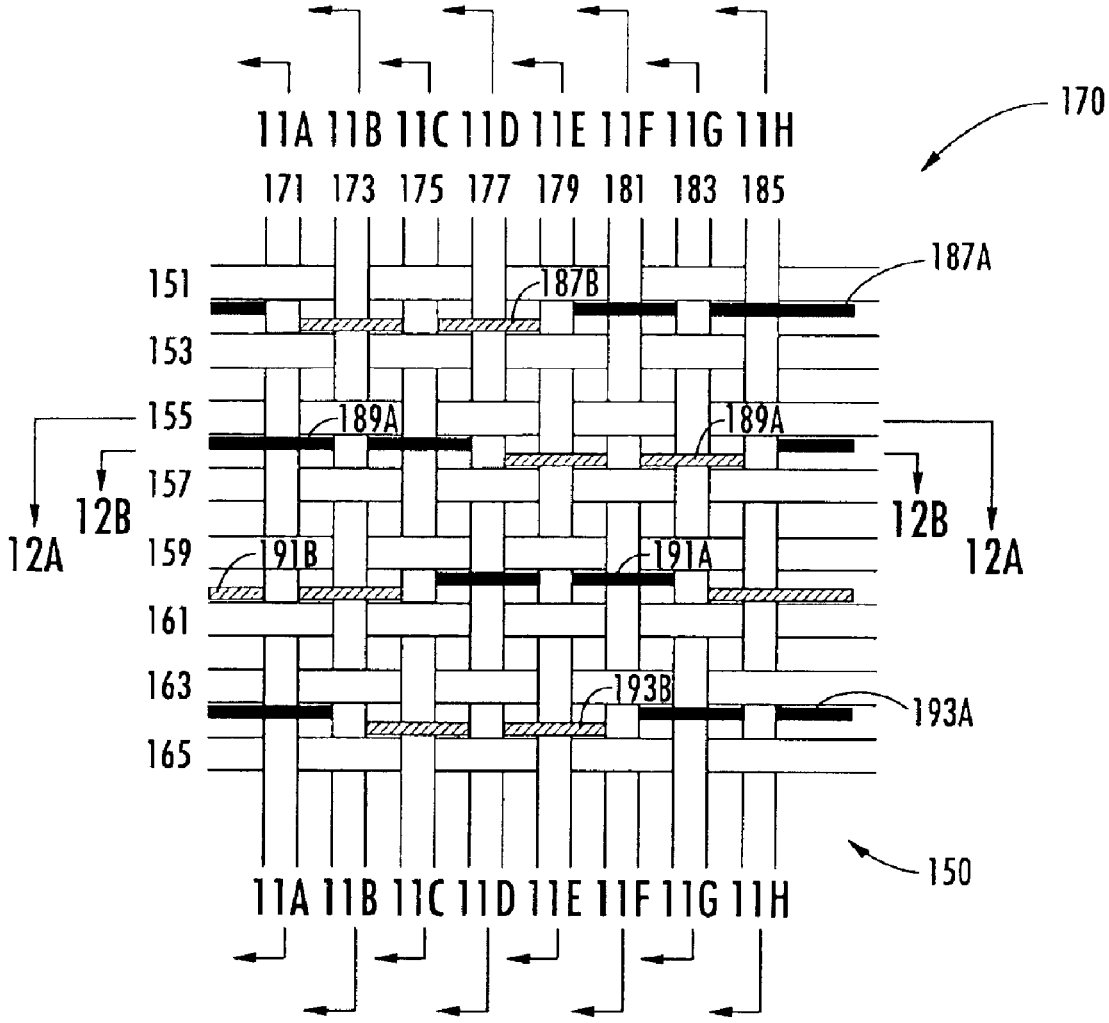
FIG. 9 is a top view of still another embodiment of a triple layer forming fabric of the present invention having pairs of stitching yarns.
Figure 10:
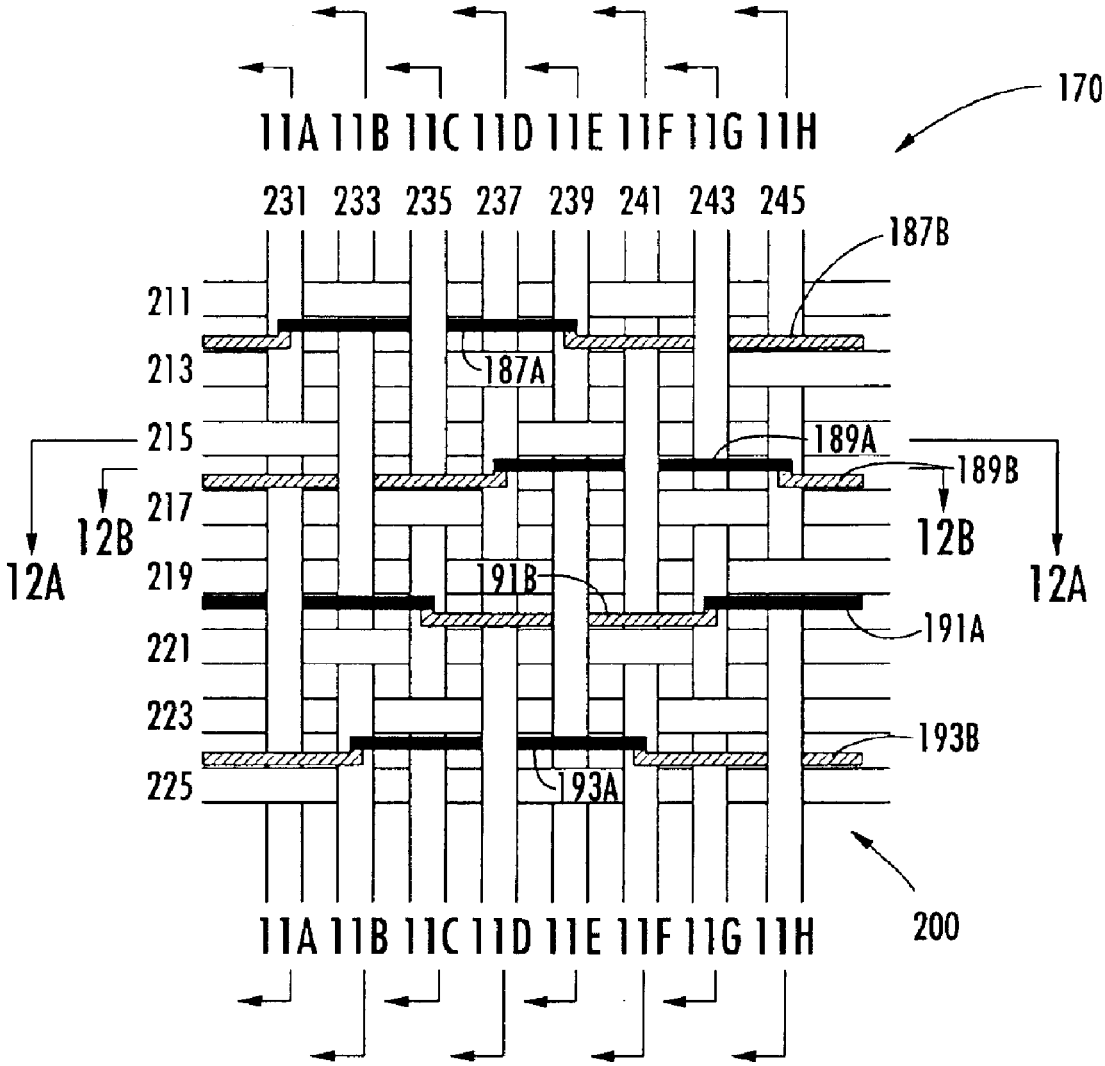
FIG. 10 is a top section view of the bottom layer of the fabric of FIG. 9 with the top layer removed.
Figure 11A:
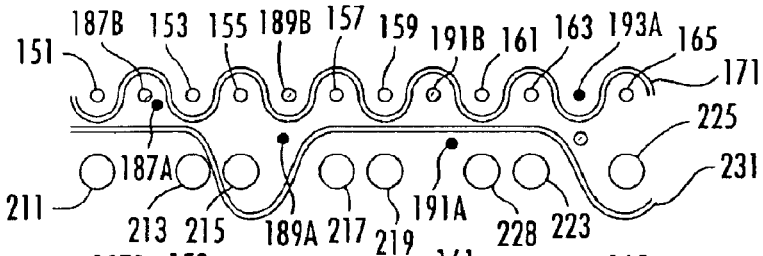
FIGS. 11A–11H are section views taken along, respectively, lines 11A—11A through 11H—11H shown in FIGS. 9 and 10 of the fabric thereof.
Figure 11B:
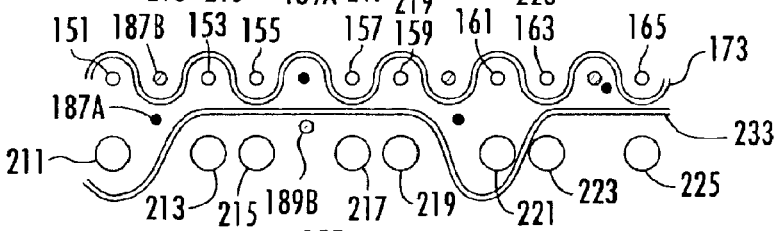
Figure 11C:
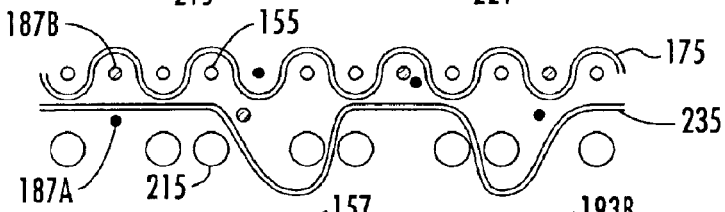
Figure 11D:
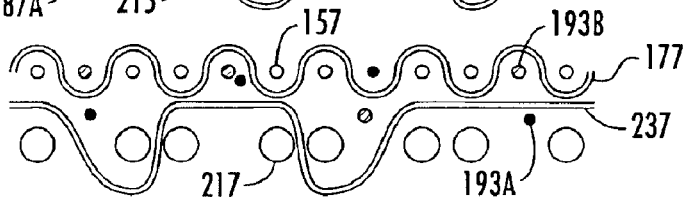
Figure 11E:
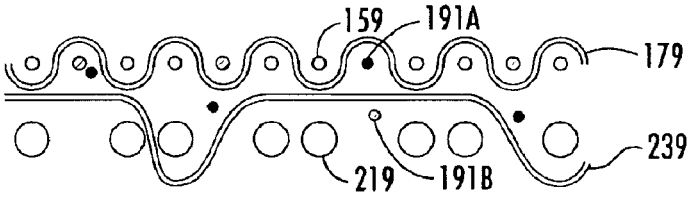
Figure 11F:
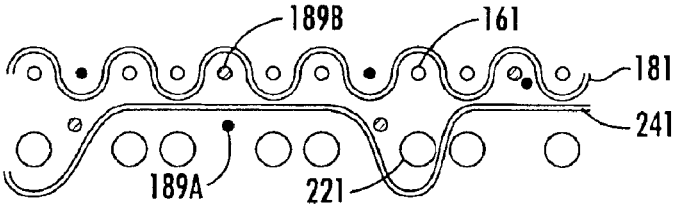
Figure 11G:
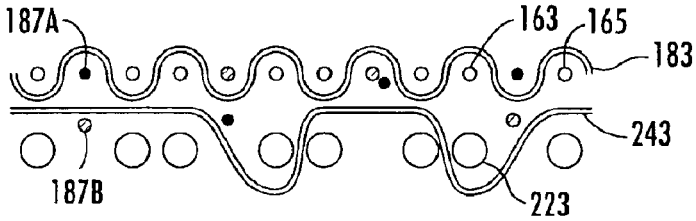
Figure 11H:
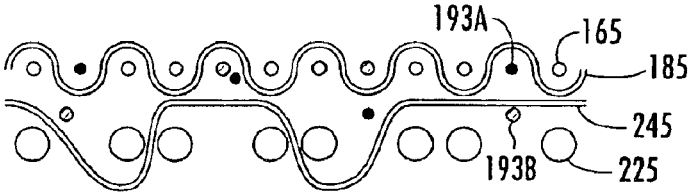

The bottom layer 200 of the fabric 170 is substantially identical to the bottom layers 80 and 120 illustrated in FIGS. 2 and 6. That is, the bottom layer 200 includes eight bottom MD direction yarns 231, 233, 235, 237, 239, 241, 243, and 245 interwoven with eight bottom CMD yarns 211, 213, 215, 217, 219, 221, 223, and 225. Like bottom layers 80 and 120, the bottom layer 200 in FIG. 10 is interwoven in an "under 1/over 4/under 1/over 2" pattern. Each knuckle formed from a bottom MD yarn passing under a bottom CMD yarn is separated from its bottom MD adjacent knuckle by two bottom CMD yarns on one side and four bottom CMD yarns on the other side. Each bottom MD yarn is offset from its adjacent bottom MD yarns by two bottom CMD yarns.

Corresponding pairs of stitching yarns in fabric 170 interweave with the top MD yarns and bottom MD yarns in the following pattern. Each of the stitching yarns of the repeat unit can be subdivided into two portions: a fiber support portion which interweaves with the top MD yarns, and a binding portion which interweaves a bottom MD yarn. These are separated at "transitional" top MD yarns, below which one stitching yarn of a pair crosses the other stitching yarn of the pair. The stitching yarns of each pair are interwoven relative to one another such that the fiber support portion of one yarn of the pair is positioned substantially above the binding portion of the other yarn of the pair. The fiber support portion of the stitching yarn of each pair designated with an "A" (e.g., 187A, 189A, 191A, 193A) interweaves in an alternating fashion with three top MD yarns in an over/under pattern as the other stitching yarn of the pair (for purposes of this example, designated with a "B") forms a binding knuckle with one bottom MD yarn.

Figure 12A:
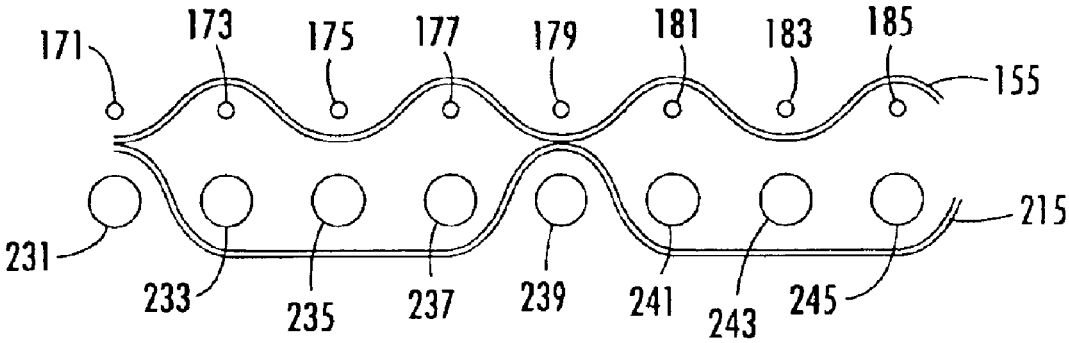
FIGS. 12A–12B are section views taken along, respectively, lines 12A—12A and 12B—12B shown in FIGS. 9 and 10 of the fabric thereof.
Figure 12B:
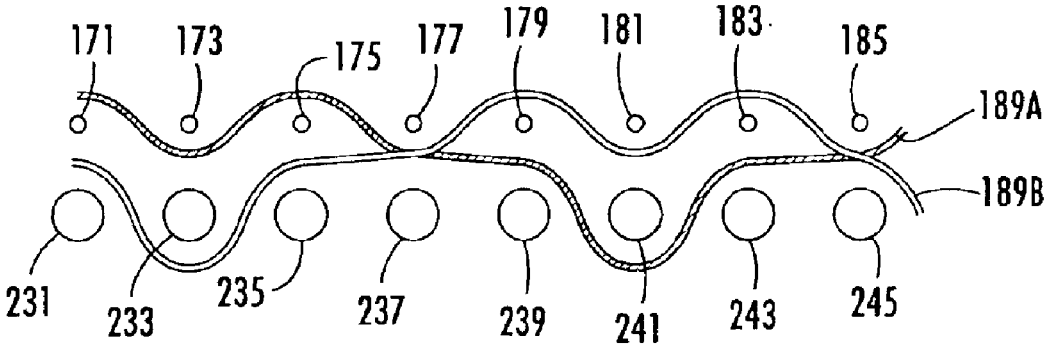

For example, in FIG. 12B, stitching yarn 189A passes over top MD yarn 171, under top MD yarn 173, over top MD yarn 175, and intersects with stitching yarn 189B beneath transitional top MD yarn 177 and above bottom MD yarn 237. Beneath this fiber support portion of stitching yarn 189A, which forms the "over/under" pattern with top MD yarns 171, 173, and 175, stitching yarn 189B passes over bottom MD yarn 231, under bottom MD yarn 233, and over bottom MD yarn 235 to form a binding knuckle at bottom MD yarn 233. The pattern for stitching yarns 189A and 189B is reversed for top MD yarns 179, 181, 183, and 185, where the fiber support portion of the stitching yarn 189B is located, and bottom MD yarns 239, 241, 243, and 245, where the binding portion of stitching yarn 189A is located. Conversely, the fiber support portion of the stitching yarn of each pair designated with a "B" (e.g., 187B, 189B) interweaves in an alternating fashion with three top MD yarns in an "over/under" pattern as the other stitching yarns of the pair (designated with an "A") forms a binding knuckle with one bottom MD yarn.

As can be seen, for example, in FIGS. 11A–11H, the stitching yarns form binding knuckles between the second and third of the four bottom CMD yarns separating bottom MD knuckles formed between bottom CMD yarns and a single bottom MD yarn. For example, in FIG. 11A, bottom MD yarn 231 passes over bottom CMD yarns 211 and 213, under bottom CMD yarn 215, over bottom CMD yarns 217, 219, 221 and 223, and under bottom CMD yarn 225. Thus, bottom MD yarn 231 forms bottom MD knuckles below bottom CMD yarns 215 and 225, which are separated by four bottom CMD yarns 217, 219, 221 and 223 on one side and two bottom CMD yarns 211 and 213 on the other. Stitching yarn 191A forms a binding knuckle under bottom MD yarn 231 between bottom CMD yarns 219 and 221, which are the second and third of the four bottom CMD yarns 217, 219, 221 and 223 that separate the two knuckles. All binding knuckles are similarly placed between the second and third bottom CMD yarns of the four bottom CMD yarns between bottom MD knuckles. As discussed with respect to fabric 10, such a placement of the binding knuckle may protect the stitching yarn, which is located equidistant from the two knuckles and beneath the highest portion of the float formed by the bottom MD yarn 231.

Another example of a triple layer fabric 250 having pairs of stitching yarns is shown in FIGS. 13-16B. The top layer 270 of the fabric 250 includes a eight top MD yarns 271, 273, 275, 277, 279, 281, 283 and 285 interwoven with eight top CMD yarns 251, 253, 255, 257, 259, 261, 263, and 265 similar to the pattern shown in top layer 150 in FIG. 7; i.e., the top MD and top CMD yarns are interwoven with stitching yarn pairs 287A, 287B, 289A, 289B, 291A, 291B, 293A and 293B in an "over/under" plain weave pattern.

Figure 14:
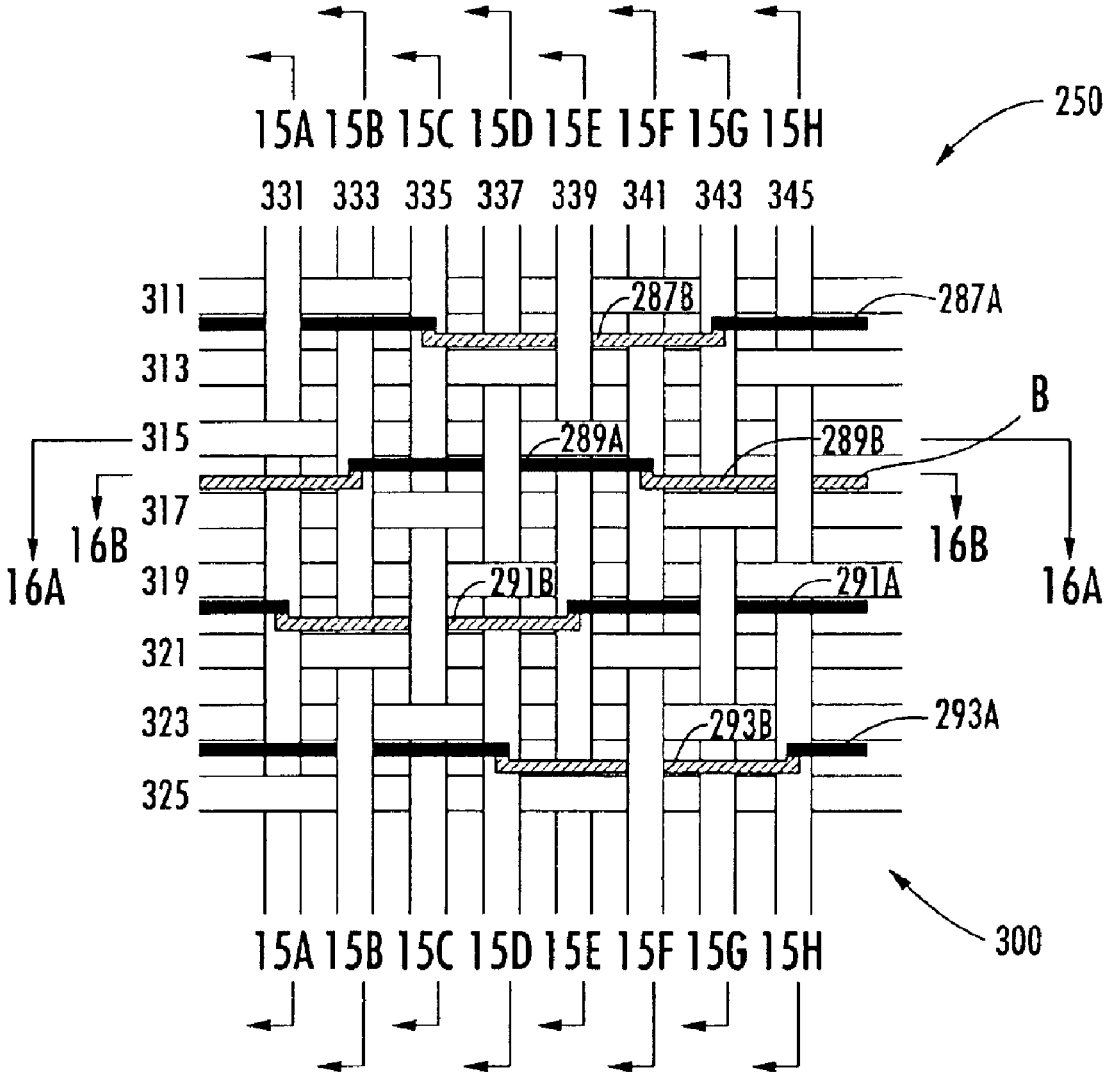
FIG. 14 is a top section view of the bottom layer of the fabric of FIG. 13 with the top layer removed.

The bottom layer 300 in FIG. 14 includes eight bottom MD yarns 331, 333, 335, 337, 339, 341, 343 and 345 interwoven with eight bottom CMD yarns 311, 313, 315, 317, 319, 321, 323 and 325 in a pattern similar to bottom layers 80 in FIG. 2, 120 in FIG. 6 and 200 in FIG. 10. Each bottom MD yarn forms knuckles with two non-adjacent bottom CMD yarns that are separated from each other by four bottom CMD yarns on one side and two bottom CMD yarns on the other.

Figure 13:
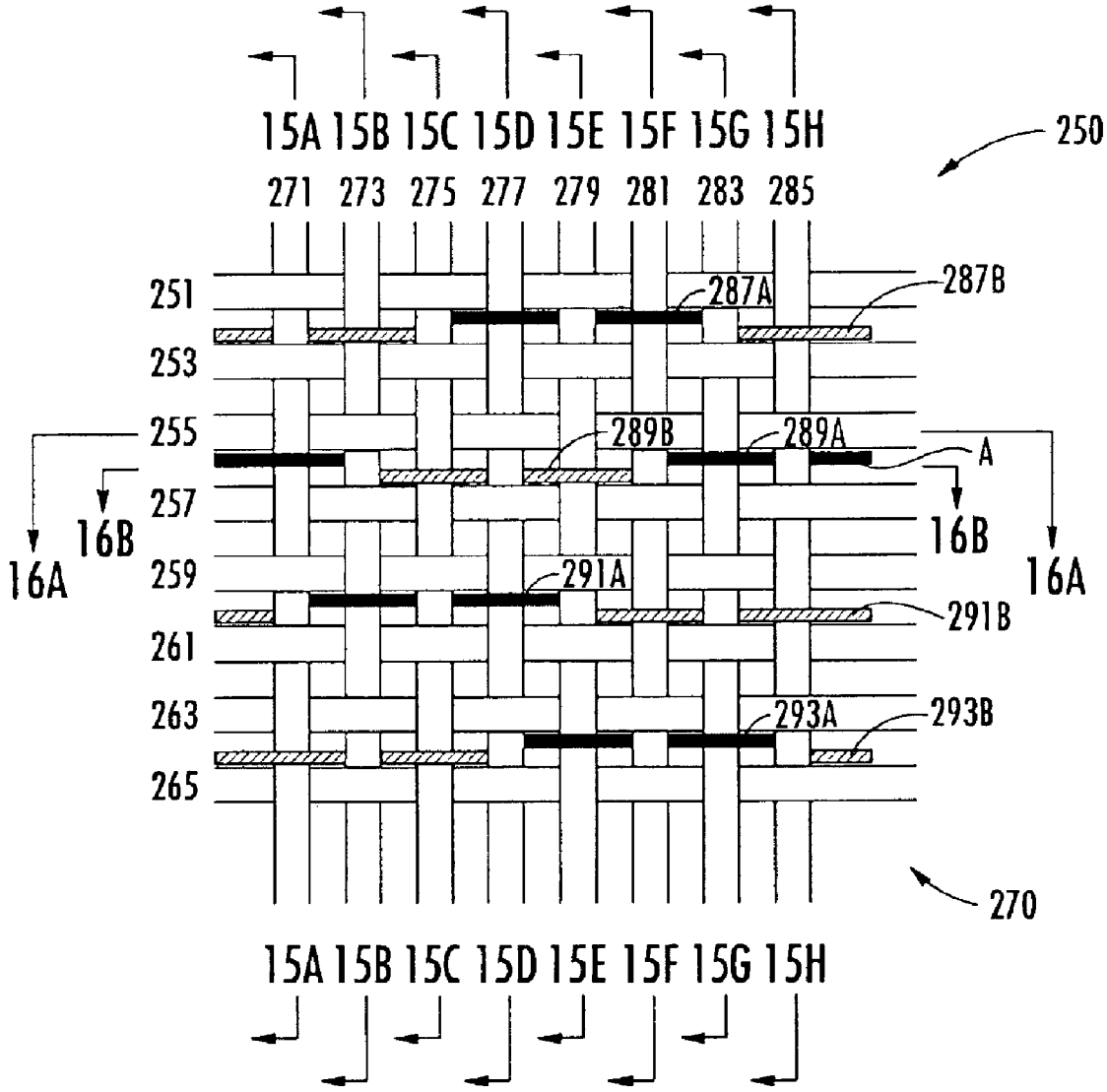
FIG. 13 is a top view of a further embodiment of a triple layer forming fabric of the present invention having pairs of stitching yarns.

The stitching yarn pairs follow a pattern similar to that described with respect to fabric 170. As can be seen in FIGS. 13 and 14, and in particular FIG. 16B, each stitching yarn alternately forms a binding knuckle with the bottom layer as its companion yarn of the stitching yarn pair interweaves with the top layer. For example, stitching yarn 289A forms a knuckle with bottom MD yarn 337 as stitching yarn 289B interweaves with the top layer 270 by passing over top MD yarn 275, under top MD yarn top 277, over top MD yarn 279 and crossing stitching yarn 289A below transitional top MD yarn 281 and above bottom MD yarn 341. However, in this fabric embodiment, the stitching yarns form binding knuckles between two bottom CMD yarns separating bottom MD yarn knuckles.

Figure 15A:
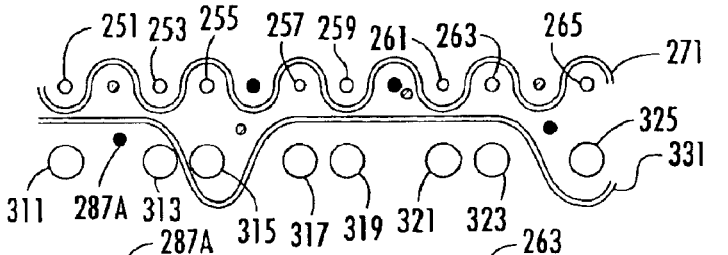
FIGS. 15A–15H are section views taken along, respectively, lines 15A—15A through 15H—15H shown in FIGS. 13 and 14 of the fabric thereof.
Figure 15B:
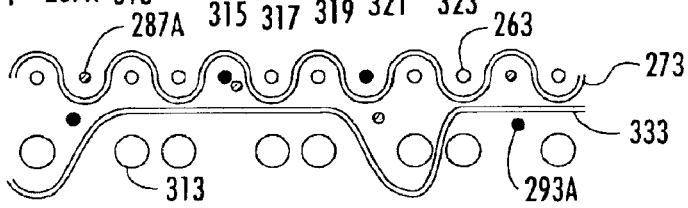
Figure 15C:
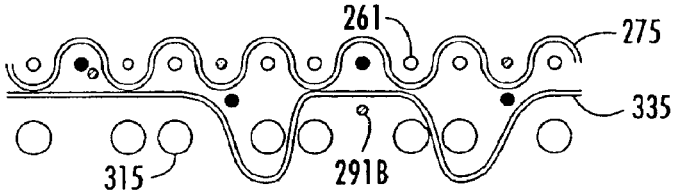
Figure 15D:
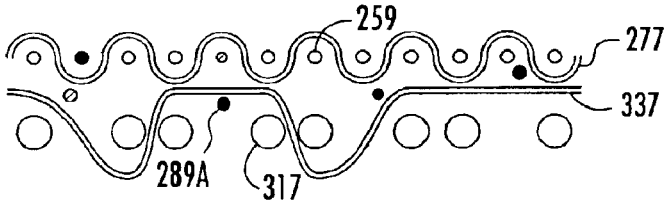
Figure 15E:
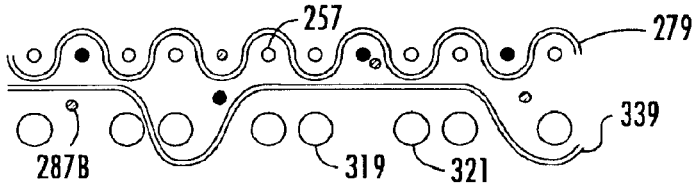
Figure 15F:
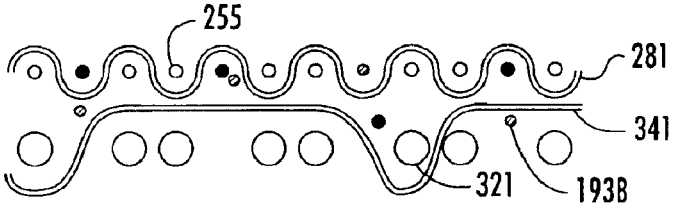
Figure 15G:
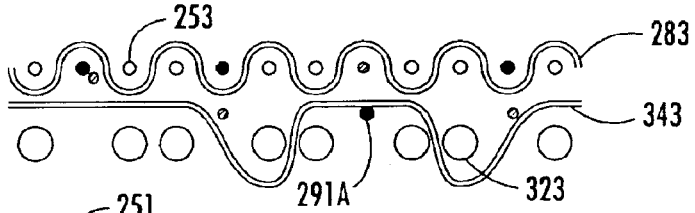
Figure 15H:
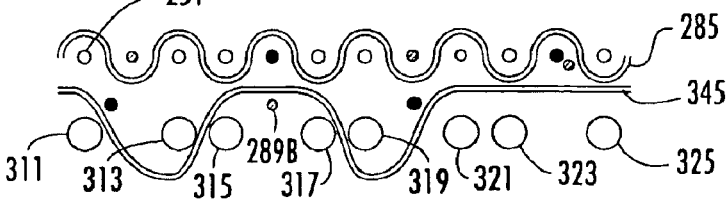
Figure 16A:
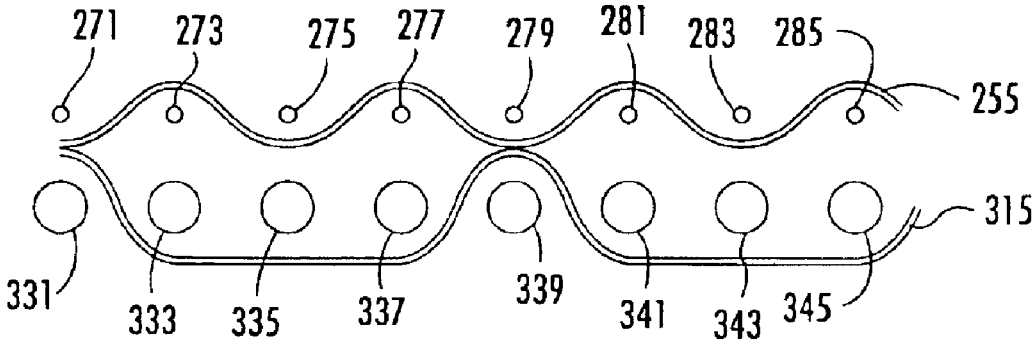
FIGS. 16A–16B are section views taken along, respectively, lines 16A—16A and 16B—16B shown in FIGS. 13 and 14 of the fabric thereof.
Figure 16B:
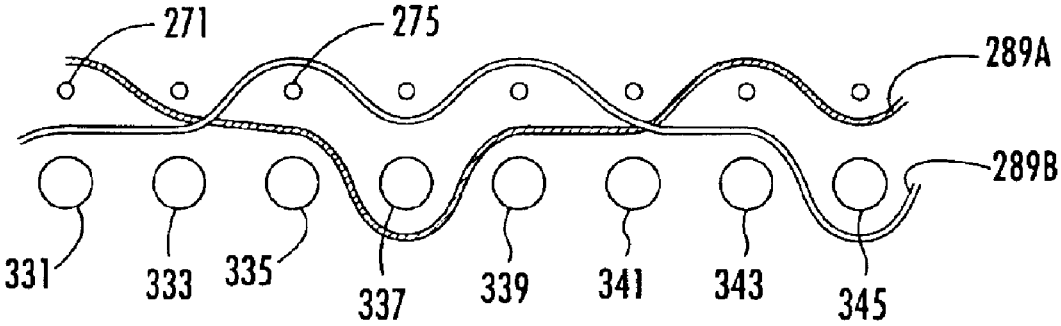

As an example and as shown in FIG. 15A, bottom MD yarn 331 passes over bottom CMD yarns 311 and 313, under bottom CMD yarn 315, over bottom CMD yarns 317, 319, 321 and 323, and under bottom CMD yarn 325. Knuckles are formed by bottom MD yarn 331 at bottom CMD yarns 325 and 315. The stitching yarn 287A forms a binding knuckle with bottom MD yarn 331 between two bottom CMD yarns 311 and 313, which separate the knuckles at bottom CMD yarns 325 and 315. As discussed with respect to fabric 100 in FIGS. 5–8B, placement of the binding knuckle between two bottom CMD yarns that separate bottom MD knuckles may protect the stitching yarn from the papermaking surface.

The stitching yarn pairs shown in fabrics 170 and 250 in FIGS. 9–16B are stitched in a "reversed picks" configuration. The "reversed picks" configuration is described in detail in U.S. Pat. Nos. 5,967,195 and 6,145,550 to Ward. To summarize for the present invention, the presence of reversed picks in a double-pick-stitched triple layer fabric can be established by locating the transitional top MD yarns and determining the most predominant diagonal formed by the transitional top MD yarns, the most predominant diagonal being the diagonal having the minimum number of steps between transitional top MD yarns. If the fiber support portions of successive stitch yarn pairs on one side of this diagonal are closer to each other in some cases and further apart in others, then the fabric can be said to have at least some "reversed picks" in the stitching yarn configuration. Although it is preferred that all of the stitching yarn pairs follow this pattern, i.e., that 50% of the stitching yarn pairs be "reversed", some benefit can be obtained by reversing only a smaller percentage (for example 25, 33 or 40%) of the stitching yarn pairs.

Other stitching yarn configurations can be used. For example, the stitching yarns may be "pseudo-stitching" yarn pairs. In a pseudo-stitching yarn configuration, only one of the yarns in a stitching yarn pair forms a knuckle with the bottom MD yarns. Referring to FIG. 12B, the stitching yarns 189A and 189B could be modified to be pseudo-stitching yarns if only one of the stitching yarns 189A and 189B stitched underneath bottom MD yarn 233 or 241. For example, in a pseudo-stitching yarn configuration, if stitching yarn 189B passes underneath bottom MD yarn 233, then stitching yarn 189A would be modified from FIG. 12B to pass above bottom MD yarn 241. As another example of an alternative stitching yarn configuration with reference to FIGS. 4B and 8B, the stitching yarns 53 and 99 may interlace with the bottom MD yarns only once in the repeat unit. For example, stitching yarn 53 may be configured such that it passes over top of bottom MD yarn 63 and under top MD yarn 13, rather than stitching underneath bottom MD yarn 63 as shown. In addition, or alternatively, the stitching yarns may not interlace with the top MD yarns as frequently as shown.

As would be understood by those of ordinary skill in the art, the weave patterns described with reference to FIGS. 1-8B may be woven with either four or eight harnesses on the paper side (top layer) and either four or eight harnesses on the machine side (bottom layer) of the fabric. Certain variations of the weave patterns shown in FIGS. 1–8B may require eight harnesses. For example, if the stitching yarn 53 in FIG. 4B is configured so that it only interlaces with one of the bottom MD yarns 63 or 71, then eight harnesses are needed. As used herein, it should be understood that weave patterns described with reference to four harnesses (or four CMD or four MD yarns) include weave patterns with eight harnesses, i.e., two sets of four harnesses. The weave patterns described with reference to FIGS. 9–16B are generally woven with eight harnesses.

Although illustrated embodiments employ plain weave pattern top layers, the fabrics of the present invention may also employ other top layer weave patterns; for example, satins, broken twills, and the like may also be employed. The stitching yarns may comprise an integral portion of the top surface weave or may not.

The form of the yarns utilized in the fabrics of the present invention can vary, depending upon the desired properties of the final papermaker's fabric. For example, the yarns may be multifilament yarns, monofilament yarns, twisted multifilament or monofilament yarns, spun yarns, or any combination thereof. Also, the materials comprising yarns employed in the fabric of the present invention may be those commonly used in papermaker's fabric. For example, the yarns may be formed of polypropylene, polyester, aramid, nylon, or the like. The skilled artisan should select a yarn material according to the particular application of the final fabric. In particular, round monofilament yarns formed of polyester or nylon are preferred.

Yarn sizes should also be selected according to the desired papermaking properties of the fabric. As an example, generally, for fine paper applications, top MD yarns have a diameter of between about 0.13 mm and 0.17 mm, top CMD yarns have a diameter of between about 0.13 mm and 0.20 mm, stitching yarns have a diameter of between about 0.11 mm and 0.15 mm, bottom MD yarns-have a diameter of between about 0.17 mm and 0.25 mm, and bottom CMD yarns have a diameter of between about 0.20 mm and 0.35 mm.

The foregoing embodiments are illustrative of the present invention, and are not to be construed as limiting thereof. The invention is defined by the following claims, with equivalents of the claims to be included therein.

That which is claimed is:

1. A papermaker's fabric, comprising top machine direction yarns, top cross machine direction yarns, bottom machine direction yarns, bottom cross machine direction yarns and stitching yarns, the fabric being formed in a plurality of repeating units, each of the repeating units comprising:

a set of top machine direction yarns;

a set of top cross machine direction yarns interwoven with the set of top machine direction yarns to form a top fabric layer;

a set of four bottom machine direction yarns;

a set of bottom cross machine direction yarns interwoven with the set of bottom machine direction yarns to form a bottom fabric layer; and a set of stitching yarns interwoven with the top and bottom fabric layers;

wherein the bottom machine direction yarns and the bottom cross machine direction yarns are interwoven in a series of repeat units in which each of the bottom machine direction yarns passes below two nonadjacent bottom cross machine direction yarns to form bottom machine direction knuckles, each bottom machine direction knuckle being separated from one adjacent knuckle formed by that bottom machine direction yarn by two bottom cross machine direction yarns and separated from another adjacent knuckle by four bottom cross machine direction yarns;

wherein each of the stitching yarns forms a binding knuckle with one of the bottom machine direction yarns between adjacent knuckles and each of the binding knuckles is located between the two cross machine direction yarns separating two adjacent bottom machine direction knuckles.

2. The papermaker's fabric defined in claim 1, wherein each of the bottom machine direction yarns is offset from adjacent bottom machine direction yarns by two bottom cross machine direction yarns.

3. The papermaker's fabric defined in claim 1, wherein the set of stitching yarns comprises pairs of first and second stitching yarns positioned between pairs of adjacent top cross machine direction yarns.

4. The papermaker's fabric defined in claim 1, wherein the set of stitching yarns comprises one stitching yarn between pairs of adjacent top CMD yarns.

5. The papermaker's fabric defined in claim 1, wherein the set of top machine direction yarns comprises four top machine direction yarns.

6. The papermaker's fabric defined in claim 1, wherein the set of bottom cross machine direction yarns comprises eight bottom cross machine direction yarns.

7. A pacemaker's fabric, comprising top machine direction yarns, top cross machine direction yarns, bottom machine direction yarns, bottom cross machine direction yarns and stitching yarns, the fabric being formed in a plurality of repeating units, each of the repeating units comprising:

a set of top machine direction yarns;

a set of top cross machine direction yarns interwoven with the set of top machine direction yarns to form a top fabric layer;

a set of four bottom machine direction yarns;

a set of bottom cross machine direction yarns interwoven with the set of bottom machine direction yarns to form a bottom fabric layer; and a set of stitching yarns interwoven with the top and bottom fabric layer;

wherein the bottom machine direction yarns and the bottom cross machine direction yarns are interwoven in a series of repeat units in which each of the bottom machine direction yarns passes below two nonadjacent bottom cross machine direction yarns to form bottom machine direction knuckles, each bottom machine direction knuckle being separated from one adjacent knuckle formed by that bottom machine direction yarn by two bottom cross machine direction yarns and separated from another adjacent knuckle by four bottom cross machine direction yarns;

wherein each of the stitching yarns forms a binding knuckle with one of he bottom machine direction yarns between adjacent knuckles;

wherein each of the binding knuckles is located between a second and third of the four bottom cross machine direction yarns separating two adjacent bottom machine direction knuckles.

8. A papermaker's fabric comprising top machine direction yarns, top cross machine direction yarns, bottom machine direction yarns, bottom cross machine direction yarns and stitching yarns, the fabric being formed in a plurality of repeating units, each of the repeating units comprising:

a set of top machine direction yarns;

a set of top cross machine direction yarns interwoven with the set of top machine direction yarns to form a top fabric layer;

a set of eight bottom machine direction yarns;

a set of bottom cross machine direction yarns interwoven with the set of bottom machine direction yarns to form a bottom fabric layer; and sets of first and second stitching yarns interwoven with the top and bottom fabric layers; and wherein the bottom machine direction yarns and the bottom cross machine direction yarns are interwoven in a series of repeat units in which each of the bottom machine direction yarns passes below two nonadjacent bottom cross machine direction yarns to for bottom machine direction knuckles, each bottom machine direction knuckle being separated from one adjacent knuckle formed by that bottom machine direction yarn by two cross bottom machine direction yarns and separated from another adjacent knuckle formed by that bottom machine direction yarn by four bottom cross machine direction yarns; and wherein pairs of first and second stitching yarns are positioned between pairs of top cross machine direction yarns, the first and second stitching yarns of each pair being interwoven with the top and bottom machine direction yarns, such that, as a fiber support portion of the first stitching yarn is interweaving with the top machine direction yarns, a binding portion of the second stitching yarn is positioned below the top machine direction yarns, and such that as a fiber support portion of the second stitching yarn is interweaving with the top machine direction yarns, a binding portion of the first stitching yarn is positioned below the top machine direction yarns, and such that the first and second stitching yarns cross each other as they pass below a transitional top machine direction yarn, and such that each of the binding portions of the first and second stitching yarns passes below at least one of the bottom machine direction yarns.

9. The papermaker's fabric defined in claim 8, wherein between 25 and 50 percent of adjacent pairs of first and second stitching yarns are interwoven as reversed picks.

10. The papermaker's fabric defined in claim 8, wherein each of the first and second stitching yarns forms a binding knuckle with one of the bottom machine direction yarns between adjacent bottom machine direction knuckles.

11. The papermaker's fabric defined in claim 10, wherein each of binding knuckles is located between the two cross machine direction yarns separating two adjacent bottom machine direction knuckles.

12. The papermaker's fabric defined in claim 10, wherein each of the binding knuckles is located between a second and third of the four cross machine direction yarns separating two adjacent knuckles.

13. The papermaker's fabric defined in claim 8, wherein each of the bottom machine direction yarns is offset from adjacent bottom machine direction yarns by two bottom cross machine direction yarns.

14. The papermakers fabric defined in claim 8, wherein the set of top machine direction yarns comprises eight top machine direction yarns.

15. The papermaker's fabric defined in claim 8, wherein the set of bottom cross machine direction yarns comprises eight bottom cross machine direction yarns.

16. A method of making paper, the method comprising the steps of:

(a) providing a papermaker's fabric, comprising top machine direction yarns, top cross machine direction yarns, bottom machine direction yarns, bottom cross machine direction yarns and stitching yarns, the fabric being formed in a plurality of repeating units, each of the repeating units comprising:

a set of top machine direction yarns;

a set of top cross machine direction yarns interwoven with the set of top machine direction yarns to form a top fabric layer;

a set of four bottom machine direction yarns;

a set of bottom cross machine direction yarns interwoven with the set of bottom machine direction yarns to form a bottom fabric layer; and a set of stitching yarns interwoven with the top and bottom fabric layers;

wherein the bottom machine direction yarns and the bottom cross machine direction yarns are interwoven in a series of repeat units in which each of the bottom machine direction yarns passes below two nonadjacent bottom cross machine direction yarns to form bottom machine direction knuckles, each bottom machine direction knuckle being separated from one adjacent knuckle by two bottom cross machine direction yarns and separated from another adjacent knuckle formed by that bottom machine direction yarn by four bottom cross machine direction yarns; and wherein pairs of first and second stitching yarns are positioned between pairs of top cross machine direction yarns, the first and second stitching yarns of each pair being interwoven with the top and bottom machine direction yarns, such that, as a fiber support portion of the first stitching yarn is interweaving with the top machine direction yarns, a binding portion of the second stitching yarn is positioned below the too machine direction yarns, and such that as a fiber support portion of the second stitching yarn is interweaving with the top machine direction yarns, a binding portion of the first stitching yarn is positioned below the top machine direction yarns, and such that the first and second stitching yarn cross each other as they pass below a transitional top machine direction yarn, and such that each of the binding portions of the first and second stitching yarns passes below at least one of the bottom machine direction yarns;

(b) applying paper stock to the papermaker's fabric; and (c) removing moisture from the paper stock.

17. The method defined in claim 16, wherein each of the stitching yarns forms a binding knuckle with one of the bottom machine direction yarns between adjacent bottom machine direction knuckles.

18. The method defined in claim 17, wherein each of the binding knuckles is located between the two cross machine direction yarns separating two adjacent bottom machine direction knuckles.

19. The method defined in claim 17, wherein each of the binding knuckles is located between a second and third of the four bottom cross machine direction yarns separating two adjacent bottom machine direction knuckles.

20. The method defined in claim 16, wherein each of the bottom machine direction yarns is offset from adjacent bottom machine direction yarns by two cross machine direction yarns.

21. The method defined in claim 16, wherein between 25 and 50 percent of adjacent pairs of first and second stitching yarns are interwoven as reversed picks.

22. The method defined in claim 16, wherein the set of top machine direction yarns comprises eight top machine direction yarns.

23. The method defined in claim 16, wherein the set of bottom cross machine direction yarns comprises eight bottom cross machine direction yarns.

24. A papermaker's fabric, comprising top machine direction yarns, top cross machine direction yarns, bottom machine direction yarns, bottom cross machine direction yarns and stitching yarns, the fabric being formed in a plurality of repeating units, each of the repeating units comprising:

a set of eight top machine direction yarns;

a set of top cross machine direction yarns interwoven with the set of top machine direction yarns to form a top fabric layer;

a set of eight bottom machine direction yarns;

a set of bottom cross machine direction yarns interwoven with the set of bottom machine direction yarns to form a bottom fabric layer; and a set of stitching yarns interwoven with the top and bottom fabric layers;

wherein the bottom machine direction yarns and the bottom cross machine direction yarns are interwoven in a series of repeat units in which each of the bottom machine direction yarns passes below two nonadjacent bottom cross machine direction yarns to form bottom machine direction knuckles, each bottom machine direction knuckle being separated from one adjacent knuckle formed by that bottom machine direction yarn by two bottom cross machine direction yarns and separated from another adjacent knuckle by four bottom cross machine direction yarns; and wherein pairs of first and second stitching yarns are positioned between pairs of top cross machine direction yarns, the first and second stitching yarns of each pair being interwoven with the toy and bottom machine direction yarns, such that, as a fiber support portion of the first stitching yarn is interweaving with the top machine direction yarns, a binding portion of the second stitching yarn is positioned below the top machine direction yarns, and such that as a fiber support portion of the second stitching yarn is interweaving with the top machine direction yarns, a binding portion of the first stitching yarn is positioned below the top machine direction yarns, and such that the first and second stitching yarns cross each other as they pass below a transitional top machine direction yarn, and such that each of the binding portions of the first and second stitching yarns passes below at least one of the bottom machine direction yarns.

* * * * *

UNITED STATES PATENT AND TRADEMARK OFFICE

CERTIFICATE OF CORRECTION

PATENT NO. : 6,860,969 B2
DATED : March 1, 2005
INVENTOR(S) : Troughton

It is certified that error appears in the above-identified patent and that said Letters Patent is hereby corrected as shown below:

Column 11,
Line 62, should read -- bottom cross machine direction yams to form bottom --.

Signed and Sealed this

Sixteenth Day of August, 2005

JON W. DUDAS
*Director of the United States Patent and Trademark Office*

UNITED STATES PATENT AND TRADEMARK OFFICE

CERTIFICATE OF CORRECTION

PATENT NO. : 6,860,969 B2
APPLICATION NO. : 10/354452
DATED : March 1, 2005
INVENTOR(S) : Troughton It is certified that error appears in the above-identified patent and that said Letters Patent is hereby corrected as shown below:

Column 11,
Line 62, should read -- bottom cross machine direction yarns to form bottom --.

This certificate supersedes Certificate of Correction issued August 16, 2005.

Signed and Sealed this

Twelfth Day of December, 2006

JON W. DUDAS
*Director of the United States Patent and Trademark Office*